US008951365B2

(12) United States Patent
Hirakami et al.

(10) Patent No.: US 8,951,365 B2
(45) Date of Patent: Feb. 10, 2015

(54) HIGH STRENGTH STEEL AND HIGH STRENGTH BOLT EXCELLENT IN DELAYED FRACTURE RESISTANCE AND METHODS OF PRODUCTION OF SAME

(75) Inventors: Daisuke Hirakami, Tokyo (JP); Tetsushi Chida, Tokyo (JP); Toshimi Tarui, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/576,530

(22) PCT Filed: Mar. 11, 2011

(86) PCT No.: PCT/JP2011/056482

§ 371 (c)(1),
(2), (4) Date: Aug. 1, 2012

(87) PCT Pub. No.: WO2011/111873

PCT Pub. Date: Sep. 15, 2011

(65) Prior Publication Data

US 2012/0298262 A1 Nov. 29, 2012

(30) Foreign Application Priority Data

Mar. 11, 2010 (JP) ..... 2010-054648

(51) Int. Cl.

| | |
|---|---|
| ***C23C 8/26*** | (2006.01) |
| ***C23C 8/00*** | (2006.01) |
| ***C22C 38/02*** | (2006.01) |
| ***C22C 38/04*** | (2006.01) |
| ***C21D 8/06*** | (2006.01) |
| ***C21D 9/00*** | (2006.01) |
| ***C21D 9/52*** | (2006.01) |
| ***C22C 38/00*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C23C 8/32*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |

(52) U.S. Cl.

CPC . *C23C 8/26* (2013.01); *C21D 8/065* (2013.01); *C21D 9/0093* (2013.01); *C21D 9/52* (2013.01); *C21D 9/525* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C23C 8/32* (2013.01); *C22C 38/08* (2013.01); *C22C 38/12* (2013.01); *C22C 38/14* (2013.01); *C22C 38/16* (2013.01); *C22C 38/18* (2013.01); *C21D 2211/008* (2013.01); *C21C 2221/10* (2013.01)

USPC ..... 148/318; 148/212; 148/230; 420/117; 420/120

(58) Field of Classification Search

USPC ..... 148/212, 230, 238, 318, 330, 332–336; 420/89–93, 104–106, 108–112, 117, 420/119–121, 123–127

See application file for complete search history.

(56) References Cited

U.S. PATENT DOCUMENTS 6,017,641 A 1/2000 Aoki et al.

FOREIGN PATENT DOCUMENTS

| | | |
|---|---|---|
| GB | 592945 A | 10/1947 |
| JP | 64-4566 B2 | 1/1989 |

(Continued)

OTHER PUBLICATIONS

Hiragami et al., English machine translation of JP 2009-299181, Dec. 24, 2009, p. 1-15.*

(Continued)

*Primary Examiner* — Roy King
*Assistant Examiner* — Caitlin Kiechle
(74) *Attorney, Agent, or Firm* — Birch, Stewart, Kolasch & Birch, LLP

(57) ABSTRACT

A steel which is excellent in delayed fracture resistance containing, by mass %, C: 0.10 to 0.55%, Si: 0.01 to 3%, and Mn: 0.1 to 2%, further containing one or more of Cr: 0.05 to 1.5%, V: 0.05 to 0.2%, Mo: 0.05 to 0.4%, Nb: 0.001 to 0.05%, Cu: 0.01 to 4%, Ni: 0.01 to 4%, and B: 0.0001 to 0.005%, and having a balance of Fe and unavoidable impurities, the structure being a mainly tempered martensite structure, the surface of the steel being formed with (a) a nitrided layer having a certain thickness range and a nitrogen concentration higher than the nitrogen concentration of the steel by 0.02 mass % or more and (b) a low carbon region having a certain depth range from the surface of the steel and having a carbon concentration of 0.9 time or less the carbon concentration of the steel.

18 Claims, 4 Drawing Sheets

(56) References Cited

FOREIGN PATENT DOCUMENTS

| | | | |
|---|---|---|---|
| JP | 3-243744 | A | 10/1991 |
| JP | 3-243745 | A | 10/1991 |
| JP | 4-285142 | A | 10/1992 |
| JP | 08165557 | A | 6/1996 |
| JP | 10-141341 | A | 5/1998 |
| JP | 10-226817 | A | 8/1998 |
| JP | 10-251803 | A | 9/1998 |
| JP | 11-335733 | A | 12/1999 |
| JP | 2000-337332 | A | 12/2000 |
| JP | 2000-337333 | A | 12/2000 |
| JP | 2000-337334 | A | 12/2000 |
| JP | 2003-113444 | A | 4/2003 |
| JP | 2009-299180 | A | 12/2009 |
| JP | 2009-299181 | A | 12/2009 |

OTHER PUBLICATIONS

Kurokawa et al., English machine translation of JP 10-226817, Aug. 25, 1998, p. 1-16.*

International Search Report issued in PCT/JP2011/056482, mailed on Jun. 21, 2011.

Extended European Search Report dated Jul. 4, 2013 for European Application No. 11753527.8.

Final Office Action dated Aug. 15, 2013 in U.S. Appl. No. 13/515,444.

International Search Report for PCT/JP2011/056481 dated Jun. 21, 2011.

Non-Final Office Action dated May 3, 2013 in U.S. Appl. No. 13/515,444.

Extended European Search Report, dated Nov. 22, 2013, for European Application No. 11753528.6.

* cited by examiner

HIGH STRENGTH STEEL AND HIGH STRENGTH BOLT EXCELLENT IN DELAYED FRACTURE RESISTANCE AND METHODS OF PRODUCTION OF SAME

TECHNICAL FIELD

The present invention relates to a high strength steel which is used for wire rods, PC steel bars (steel bars for prestressed concrete use), etc., more particularly relates to a high strength steel and high strength bolts of a tensile strength of 1300 MPa or more which are excellent in delayed fracture resistance and methods for the production of the same.

BACKGROUND ART

The high strength steel which is used in large amounts for machines, automobiles, bridges, and building structures is medium carbon steel with an amount of C of 0.20 to 0.35%, for example, SCr, SCM, etc. defined by JIS G 4104 and JIS G 4105 which is quenched and tempered. However, in all types of steels, if the tensile strength exceeds 1300 MPa, the risk of delayed fracture occurring becomes larger.

As methods for improving the delayed fracture resistance of high strength steel, the method of making the steel structure a bainite structure or the method of refining the prior austenite grains is effective.

PLT 1 discloses steel which is refined in prior austenite grains and improved in delayed fracture resistance, while PLT's 2 and 3 disclose steels which suppress segregation of steel ingredients to improve the delayed fracture resistance. However, with refinement of prior austenite grains or with suppression of segregation of ingredients, it is difficult to greatly improve the delayed fracture resistance.

A bainite structure contributes to improvement of the delayed fracture resistance, but formation of a bainite structure requires suitable additive elements or heat treatment, so the cost of the steel rises.

PLT's 4 to 6 disclose wire rods for high strength bolts containing 0.5 to 1.0 mass % of C in which an area ratio 80% or more of the pearlite structure is strongly drawn to impart 1200N/mm$^2$ or more strength and excellent delayed fracture resistance. However, the wire rods which are described in PLT's 4 to 6 are high in cost due to the drawing process. Further, manufacture of thick wire rods is difficult.

PLT7 discloses a coil spring in which development of a delayed fracture after cold-coiling is prevented, using an oil tempered wire having a hardness in the inner part of cross section of ≥Hv 550. However, the coil spring has a surface layer hardness after nitriding of Hv 900 or more, and a product, for example, in the form of bolt or PC steel bar has a low delayer fracture under a high load stress. Thus, developing a delayed fracture in a severe corrosion environment is a problem.

PLT8 discloses a high strength steel having excellent delayed fracture resistance mainly comprised of tempered martensite structure, which is obtained by nitriding a steel having a certain composition. The high strength steel disclosed in PLT8 displays a delayed fracture resistance even in a corrosion environment containing hydrogen.

Nevertheless, corrosion environments have recently become severe, and a high strength steel displaying excellent delayed fracture resistance even in severe corrosion environments is needed.

CITATIONS LIST

Patent Literature

PLT 1: JP-B2-64-4566
PLT 2: JP-A-3-243744
PLT 3: JP-A-3-243745
PLT 4: JP-A-2000-337332
PLT 5: JP-A-2000-337333
PLT 6: JP-A-2000-337334
PLT 7: JP-A-10-251803
PLT 8: JP-A-2009-299180

SUMMARY OF INVENTION

Technical Problem

As explained above, in high strength steels, there is a limit to improving the delayed fracture resistance by conventional methods. As a method for improving the delayed fracture resistance, there is the method of causing fine precipitates to diffuse in the steel and trapping hydrogen by the precipitates. However, even if employing this method, it is difficult to effectively suppress delayed fracture when the amount of hydrogen which enters from the outside is large.

The present invention, in view of this current situation, has as its object to provide a high strength steel (wire rod or PC steel bar) and high strength bolt which exhibit excellent delayed fracture resistance even under a severe corrosive environment and methods of production for producing these inexpensively.

Solution to Problem

The inventors engaged in intensive research on the techniques for solving the above problem. As a result, they learned that if (a) decarburizing and nitriding the surface of the steel (a1) to form a low carbon region to suppress hardening and (a2) to form a nitrided layer to obstruct absorption of hydrogen, the delayed fracture resistance is remarkably improved.

The present invention was made based on the above discovery and has as its gist the following:

(1) A steel which is excellent in delayed fracture resistance containing, by mass %, C: 0.10 to 0.55%, Si: 0.01 to 3%, and Mn: 0.1 to 2%, further containing one or more of Cr: 0.05 to 1.5%, V: 0.05 to 0.2%, Mo: 0.05 to 0.4%, Nb: 0.001 to 0.05%, Cu: 0.01 to 4%, Ni: 0.01 to 4%, and B: 0.0001 to 0.005%, and having a balance of Fe and unavoidable impurities, the structure being a mainly tempered martensite structure, the surface of the steel being formed with (a) a nitrided layer having a thickness from the surface of the steel of 200 μm or more and a nitrogen concentration of 12.0 mass % or less and higher than the nitrogen concentration of the steel by 0.02 mass % or more and (b) a low carbon region having a depth from the surface of the steel of 100 μm or more to 1000 μm or less and having a carbon concentration of 0.05 mass % or more and 0.9 time or less the carbon concentration of the steel.

(2) A high strength steel which is excellent in delayed fracture resistance as set forth in said (1) characterized in that due to the presence of the nitrided layer and low carbon region, the absorbed hydrogen content in the steel is 0.5 ppm or less and the critical diffusible hydrogen content of the steel is 0.20 ppm (2.00 ppm?) or more.

(3) A high strength steel which is excellent in delayed fracture resistance as set forth in said (1) or (2) characterized in that said steel further contains, by mass %, one or more of Al: 0.003 to 0.1%, Ti: 0.003 to 0.05%, Mg: 0.0003 to 0.01%, Ca: 0.0003 to 0.01%, and Zr: 0.0003 to 0.01%.

(4) A high strength steel which is excellent in delayed fracture resistance as set forth in any of said (1) to (3) characterized in that the nitrided layer has a thickness of 1000 μm or less.

(5) A high strength steel which is excellent in delayed fracture resistance as set forth in any of said (1) to (4) characterized in that the tempered martensite has an area ratio of 85% or more.

(6) A high strength steel which is excellent in delayed fracture resistance as set forth in any of said (1) to (5) characterized in that the steel has a compressive residual stress at the surface of 200 MPa or more.

(7) A high strength steel which is excellent in delayed fracture resistance as set forth in any of said (1) to (6) characterized in that the steel has a tensile strength of 1300 MPa or more.

(8) A high strength bolt which is excellent in delayed fracture resistance obtained by working a steel containing, by mass %, C: 0.10 to 0.55%, Si: 0.01 to 3%, and Mn: 0.1 to 2%, further containing one or more of Cr: 0.05 to 1.5%, V: 0.05 to 0.2%, Mo: 0.05 to 0.4%, Nb: 0.001 to 0.05%, Cu: 0.01 to 4%, Ni: 0.01 to 4%, and B: 0.0001 to 0.005%, and having a balance of Fe and unavoidable impurities, the structure being a mainly tempered martensite structure, the surface of the bolt being formed with (a) a nitrided layer having a thickness from the surface of the bolt of 200 μm or more and a nitrogen concentration of 12.0 mass % or less and higher than the nitrogen concentration of the steel by 0.02 mass % or more and (b) a low carbon region having a depth from the surface of the bolt of 100 μm or more to 1000 μm or less and having a carbon concentration of 0.05 mass % or more and 0.9 time or less the carbon concentration of the steel.

(9) A high strength bolt which is excellent in delayed fracture resistance as set forth in said (8) characterized in that due to the presence of the nitrided layer and low carbon region, the absorbed hydrogen content in the bolt is 0.5 ppm or less and the critical diffusible hydrogen content of the bolt is 0.20 (2.00?) ppm or more.

(10) A high strength bolt which is excellent in delayed fracture resistance as set forth in said (8) or (9) characterized in that said steel further contains, by mass %, one or more of Al: 0.003 to 0.1%, Ti: 0.003 to 0.05%, Mg: 0.0003 to 0.01%, Ca: 0.0003 to 0.01%, and Zr: 0.0003 to 0.01%.

(11) A high strength bolt which is excellent in delayed fracture resistance as set forth in any of said (8) to (10), characterized in that the nitrided layer of the bolt has a thickness of 1000 μm or less.

(12) A high strength bolt which is excellent in delayed fracture resistance as set forth in any of said (8) to (11), characterized in that the tempered martensite has an area ratio of 85% or more.

(13) A high strength bolt which is excellent in delayed fracture resistance as set forth in any of said (8) to (12), characterized in that the bolt has a compressive residual stress at the surface of 200 MPa or more.

(14) A high strength bolt which is excellent in delayed fracture resistance as set forth in any of said (8) to (13), characterized in that the bolt has a tensile strength of 1300 MPa or more.

(15) A method of production of a high strength steel which is excellent in delayed fracture resistance as set forth in any of said (1) to (7), the method of production of a high strength steel which is excellent in delayed fracture resistance characterized by (1) heating a steel having a composition as set forth in said (1) or (3) to form a low carbon region having a depth from the surface of the steel of 100 μm or more to 1000 μm or less and having a carbon concentration of 0.05 mass % or more and 0.9 time or less the carbon concentration of the steel, then cooling as it is to make the steel structure a mainly martensite structure, then (2) nitriding the steel at 500° C. or less to form on the surface of the steel a nitrided layer having a nitrogen concentration of 12.0 mass % or less and higher than the nitrogen concentration of the steel by 0.02 mass % and having a thickness from the surface of the steel of 200 μm or more and to make the steel structure a mainly tempered martensite structure.

(16) A method of production of a high strength steel which is excellent in delayed fracture resistance as set forth in said (15) characterized in that the nitrided layer has a thickness of 1000 μm or less.

(17) A method of production of a bolt which is excellent in delayed fracture resistance as set forth in any of said (8) to (14), the method of production of a bolt which is excellent in delayed fracture resistance characterized by (1) heating a bolt obtained by working a steel having a composition as set forth in said (8) or (10) to form a low carbon region having a depth from the surface of the bolt of 100 μm or more to 1000 μm or less and having a carbon concentration of 0.05 mass % or more and 0.9 time or less the carbon concentration of the steel, then cooling as it is to make the steel structure a mainly martensite structure, then (2) nitriding the bolt at 500° C. or less to form on the surface of the bolt a nitrided layer having a nitrogen concentration of 12.0 mass % or less and higher than the nitrogen concentration of the steel by 0.02 mass % and having a thickness from the surface of the bolt of 200 μm or more and to make the steel structure a mainly tempered martensite structure.

(18) A method of production of a bolt which is excellent in delayed fracture resistance as set forth in said (17), characterized in that the nitrided layer has a thickness of 1000 μm or less.

Advantageous Effect of Invention

According to the present invention, it is possible to provide a high strength steel (wire rod or PC steel bar) and high strength bolt which exhibit excellent delayed fracture resistance even in a severe corrosive environment and methods for production able to produce these inexpensively.

BRIEF DESCRIPTION OF DRAWINGS

FIG. 1(*b*) is a view which schematically shows the relationship between a fracture time obtained by a constant load delayed fracture test of a steel and an amount of diffusible hydrogen.

DESCRIPTION OF EMBODIMENTS

It is known that hydrogen in steel causes delayed fracture. Further, absorption of hydrogen into the steel occurs along with corrosion in actual environments. The absorption of diffusible hydrogen into the steel concentrates at the concentrated parts of tensile stress and results in occurrence of delayed fracture.

Figure 1A:
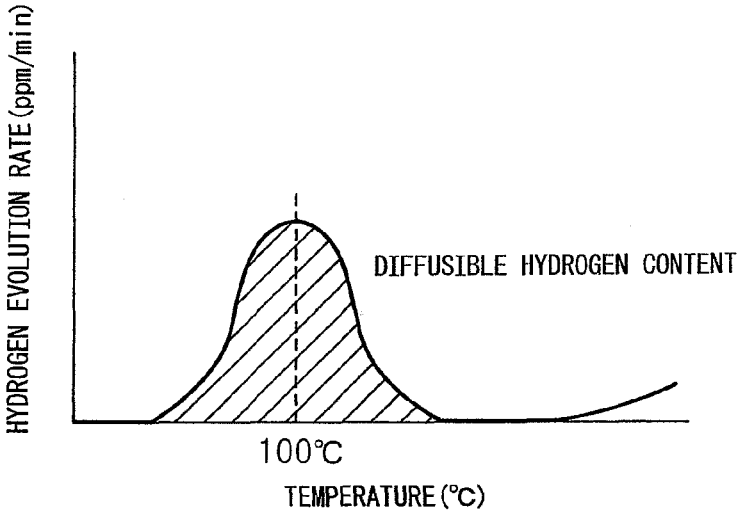
FIG. 1(*a*) is a view which schematically shows a hydrogen evolution curve which is obtained by hydrogen analysis by the Thermal desorption analysis.
Figure 1B:
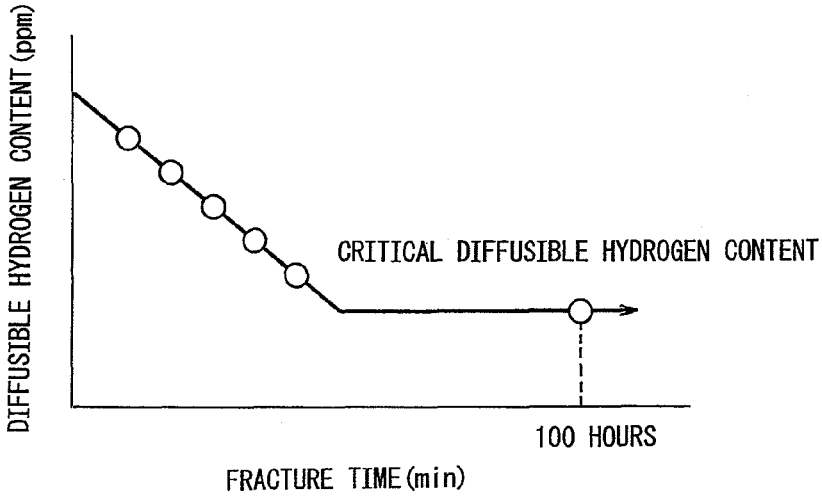

FIG. 1(*a*) schematically shows absorption of hydrogen curve obtained by hydrogen analysis by the Thermal desorption analysis. As shown in FIG. 1(*a*), the amount of release of diffusible hydrogen reaches a peak near 100° C.

In the present invention, a sample is raised in temperature by 100° C./h and the cumulative value of the amount of hydrogen which is desorbed from room temperature to 400° C. is defined as the amount of diffusible hydrogen. Note that, the amount of desorbed hydrogen can be measured by a gas chromatograph.

In the present invention, the minimum amount of diffusible hydrogen at which delayed fracture occurs is referred to as the "critical diffusible hydrogen content". The critical diffusible hydrogen content differs according to the type of the steel.

FIG. 1(*b*) schematically shows the relationship between the fracture time obtained by a constant load delayed fracture test of the steel and the amount of diffusible hydrogen. As shown in FIG. 1(*b*), if the amount of diffusible hydrogen is great, the fracture time is short, while if the amount of diffusible hydrogen is small, the fracture time is long.

That is, if the amount of diffusible hydrogen is small, delayed fracture does not occur, while if the amount of diffusible hydrogen is great, delayed fracture occurs. In the present invention, a constant load delayed fracture test of the steel is run and, as shown in FIG. 1(*b*), the maximum value of the amount of diffusible hydrogen at which no fracture occurs for 100 hours or more was made the critical diffusible hydrogen content.

If comparing the absorbed hydrogen content and the critical diffusible hydrogen content and if the critical diffusible hydrogen content is greater than the absorbed hydrogen content, delayed fracture does not occur. Conversely if the critical diffusible hydrogen content is smaller than the absorbed hydrogen content, delayed fracture occurs. Therefore, the larger the critical diffusible hydrogen content, the more the occurrence of delayed fracture is suppressed.

However, if the absorbed hydrogen content in the steel from a corrosive environment exceeds the critical diffusible hydrogen content, delayed fracture occurs.

Therefore, to prevent the occurrence of delayed fracture, it is effective to suppress absorption of hydrogen into the steel. For example, if forming a nitrided layer at the surface of the steel by nitriding, the absorbed hydrogen content due to corrosion is suppressed, so the delayed fracture resistance is improved.

However, if forming a nitrided layer at the steel surface, due to hardening of the surface layer, the critical diffusible hydrogen content decreases and the delayed fracture resistance is not improved.

Therefore, the inventors studied lowering the excessively high hardness of the nitrided layer to improve the delayed fracture resistance. Specifically, they decarburized and further nitrided the surfaces of various steels, carried out accelerated corrosion tests and exposure tests, and investigated the hydrogen absorption characteristics and delayed fracture resistance.

As a result, the inventors learned that if forming a nitrided layer of a predetermined nitrogen concentration and thickness on the surface of a steel which has a predetermined composition and structure and, furthermore, forming a low carbon region of a predetermined carbon concentration and depth on the steel surface, the delayed fracture resistance is remarkably improved compared with the case of forming only a nitrided layer on the steel surface.

This is believed to be due to the synergistic effect of (1) suppression of the absorbed hydrogen content compared with the case of a nitrided layer alone due to the formation of a nitrided layer at the low carbon region which is formed at the steel surface and (2) suppression of excessive hardening of the surface and increase of the critical diffusible hydrogen content due to the formation of the low carbon region at the steel surface.

Basically, they learned that if forming, on the surface of a steel of a predetermined composition and structure, (a) a nitrided layer having a thickness from the surface of the steel of 200 μm or more and a nitrogen concentration of 12.0 mass % or less and higher than the nitrogen concentration of the steel by 0.02 mass % or more and (b) a low carbon region having a depth from the surface of the steel of 100 μm or more to 1000 μm or less and having a carbon concentration of 0.05 mass % or more and 0.9 time or less the carbon concentration of the steel, it is possible to increase the critical diffusible hydrogen content of the steel and reduce the absorbed hydrogen content.

Further, the inventors discovered that by heating and rapid cooling at the time of nitriding, compressive residual stress occurs at the steel surface and the delayed fracture resistance is improved. In particular, in the case of a high strength bolt in which strain is introduced into the surface by working, formation of a nitrided layer is promoted. Further, the nitrogen concentration becomes higher, so the delayed fracture resistance is remarkably improved.

Below, the present invention will be explained in detail.

The high strength steel and high strength bolt of the present invention are composed of predetermined compositions of ingredients and have a nitrided layer and a low carbon region simultaneously present on the surface. That is, at the surface of the high strength steel and high strength bolt of the present invention, there is a region with a nitrogen concentration of 12.0 mass % or less and higher than the nitrogen concentration of the steel by 0.02 mass % or more and with a carbon concentration of 0.05 mass % or more and 0.9 time or less the steel (low carbon nitrided layer).

When the thickness of the nitrided layer is greater than the thickness of the low carbon region, the carbon concentration at the location deeper than the low carbon region is equal to the carbon concentration of the steel and the nitrogen concentration is higher than the nitrogen concentration of the steel. On the other hand, when the thickness of the low carbon region is greater than the thickness of the nitrided layer, the result is a low carbon region with a carbon concentration of 0.05 mass % or more and 0.9 time or less of the carbon concentration of the steel and with contents of other elements equal to the steel is present under the nitrided layer.

First, the low carbon region will be explained. In the present invention, the low carbon region is a region with a carbon concentration of 0.05 mass % or more and 0.9 time or less the carbon concentration of the high strength steel or high strength bolt.

In the high strength steel and high strength bolt of the present invention, a low carbon region is formed at a depth of 100 μm or more to 1000 μm from the steel surface. The depth and carbon concentration of the low carbon region are adjusted by the heating atmosphere, heating temperature, and holding time at the time of heat treatment which forms the low carbon region.

For example, if the carbon potential of the heating atmosphere is low, the heating temperature is high, and the holding time is long, the low carbon region becomes deeper and the carbon concentration of the low carbon region falls.

If the carbon concentration of the low carbon region is less than 0.05 mass %, this becomes less than half of the lower limit 0.10 mass % of the carbon concentration of the steel, so it is not possible to secure a predetermined strength and hardness by the low carbon region. If the carbon concentration of the low carbon region is over 0.9 time the carbon concentration of the steel, this is substantially equal to the carbon concentration of the steel and the effect of presence of the low carbon region ends up becoming weaker.

For this reason, in the present invention, the low carbon region was defined as a region where the carbon concentration is 0.05 mass % or more and 0.9 time or less the carbon concentration of the steel.

If the carbon concentration of the low carbon region is 0.05 mass % or more and 0.9 time or less of the carbon concentration of the steel, it is possible to reduce the amount of increase in the surface hardness due to formation of the nitrided layer. As a result, the hardness of the surface of the steel becomes equal to the hardness of the steel or lower than the hardness of the steel and can prevent a reduction of the critical diffusible hydrogen content.

The depth (thickness) of the low carbon region was made a depth (thickness) of 100 μm or more from the surface of the steel or bolt so that the effect is obtained. The depth (thickness) of the low carbon region is preferably greater in depth (thickness), but if over 1000 μm, the strength of the steel as a whole or the bolt as a whole falls, so the depth (thickness) of the low carbon region is given an upper limit of 1000 μm.

Next, a nitrided layer will be explained. In the present invention, the nitrided layer is a region with a nitrogen concentration of 12.0 mass % or less and higher than the nitrogen concentration of the steel or bolt by 0.02 mass % or more. Further, the nitrided layer is formed by a thickness of 200 μm or more from the surface of the steel or bolt.

The thickness and nitrogen concentration of the nitrided layer can be adjusted by the heating atmosphere, heating temperature, and holding time at the time of nitriding. For example, if the concentration of ammonia or nitrogen in the heating atmosphere is high, the heating temperature is high, and the holding time is long, the nitrided layer becomes thicker and the nitrogen concentration of the nitrided layer becomes higher.

If the nitrogen concentration of the nitrided layer is higher than the nitrogen concentration of the steel, it is possible to reduce the absorbed hydrogen content in the steel from a corrosive environment, but if the difference of the nitrogen concentration of the nitrided layer and the nitrogen concentration of the steel is less than 0.02 mass %, the effect of reduction of the absorbed hydrogen content cannot be sufficiently obtained. For this reason, the nitrogen concentration of the nitrided layer was made a concentration higher than the nitrogen concentration of the steel by 0.02 mass % or more.

On the other hand, if the nitrogen concentration exceeds 12.0 mass %, the nitrided layer excessively rises in hardness and becomes brittle, so 12.0 mass % was made the upper limit.

If the steel surface is formed with a nitrided layer which has a nitrogen concentration of 12.0 mass % or less and higher than the nitrogen concentration of the steel by 0.02 mass % or more and a depth of 200 μm or more from the surface, the absorbed hydrogen content in the steel from the corrosive environment is greatly reduced.

The nitrided layer was limited to a thickness (depth) of 200 μm or more from the surface of the steel or bolt so that the effect is obtained. The upper limit of the thickness of the nitrided layer is not particularly defined, but if the thickness is over 1000 μm, the productivity falls and a rise in cost is invited, so 1000 μm or less is preferable.

The depth (thickness) of the low carbon region which is formed on the high strength steel or high strength bolt of the present invention can be found from the curve of the carbon concentration from the surface of the steel or bolt.

A cross-section of a steel or bolt which has a low carbon region and nitrided layer on the surface is polished and an Energy Dispersive x-ray Spectroscopy (below, sometimes referred to as "EDX") or a Wavelength Dispersive X-ray Spectroscopy (below, sometimes referred to as "WDS") is used for line analysis to measure the carbon concentration in a depth direction from the surface.

Figure 2:
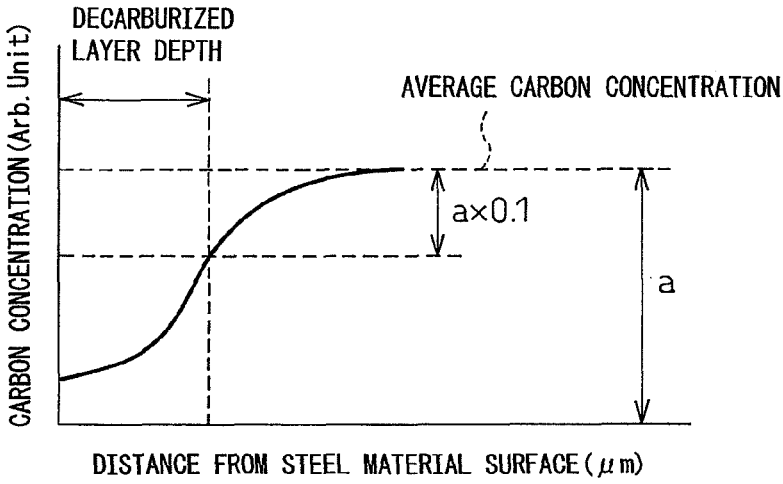
FIG. 2 is a view which shows a method of finding a depth (thickness) of a low carbon region from a carbon concentration curve which is obtained by an Energy Dispersive x-ray Spectroscopy (EDX).

FIG. 2 shows the method of finding the depth (thickness) of the low carbon region from the curve of the carbon concentration which is obtained by EDX. That is, FIG. 2 is a view which shows the relationship between the distance from the steel surface, obtained by measuring the carbon concentration in the depth direction from the surface using EDX, and the carbon concentration.

As shown in FIG. 2, the carbon concentration increases along with the increased distance (depth) from the steel surface. This is because due to decarburization, a low carbon region is formed on the surface of the steel. In the region not affected by the decarburization, the carbon concentration is substantially constant (average carbon concentration "a"). The average carbon concentration "a" is the carbon concentration of the region not affected by the decarburization and is equal to the amount of carbon of the steel before decarburization.

Therefore, in the present invention, the chemical analysis value of the carbon concentration of the steel is made the reference value when finding the depth of the low carbon region.

As shown in FIG. 2, it is possible to discriminate the range where the carbon concentration from the steel surface to the required depth becomes lower than 10% or more of the average carbon concentration "a" (a×0.1) (range of 0.9 time or less of the carbon concentration of the steel) and find the distance (depth) from the steel surface at the boundary of that range in the depth direction so as to evaluate the depth (thickness) of the low carbon region.

The thickness (depth) of the nitrided layer can be found from the change of the nitrogen concentration from the surface of the steel or bolt in the same way as the low carbon region. Specifically, a cross-section of the steel or bolt which has a low carbon region and nitrided layer on the surface is polished and an EDX or WDS is used for line analysis to measure the nitrogen concentration in the depth direction from the surface.

Figure 3:
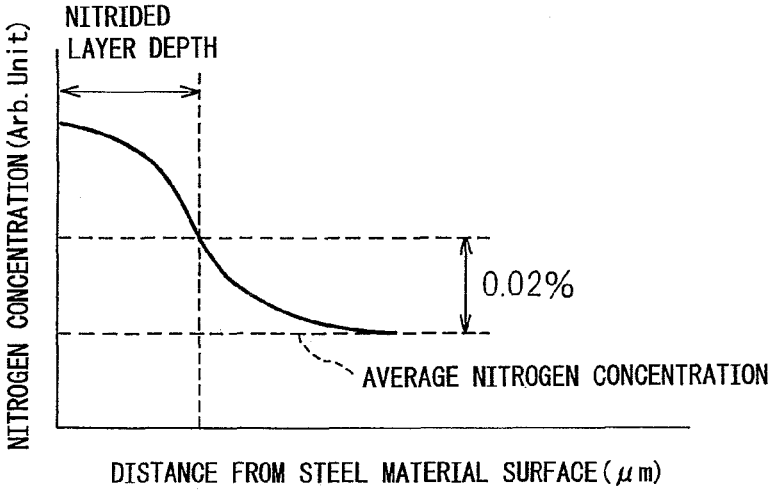
FIG. 3 is a view which shows a method of finding a thickness (depth) of a nitrided region from a nitrogen concentration curve which is obtained by an Energy Dispersive x-ray Spectroscopy (EDX).

FIG. 3 shows the method of finding the thickness (depth) of the nitrided layer from the nitrogen concentration curve obtained by an Energy Dispersive x-ray Spectroscopy (EDX). That is, FIG. 3 is a view showing the relationship between the distance from the steel surface and the nitrogen concentration which is obtained by measuring the nitrogen concentration in the depth direction from the surface using EDX.

As the distance (depth) from the steel surface becomes longer, the nitrogen concentration decreases, but in the region not affected by nitriding, the carbon concentration is substantially constant (average nitrogen concentration).

The average nitrogen concentration is a range of nitrogen concentration not affected by nitriding and is equal to the amount of nitrogen of the steel before nitriding. Therefore, in the present invention, the chemical analysis value of the nitrogen concentration of the steel is made the reference value when finding the thickness of the nitrided layer.

As shown in FIG. 3, it is possible to discriminate the region in which the nitrogen concentration from the steel surface down to the required depth becomes higher than the average nitrogen concentration by 0.02 mass % or more and finding the distance (depth) from the steel surface at the boundary of that region in the depth direction so as to evaluate the thickness (depth) of the nitrided layer.

The depth of the low carbon region and the thickness of the nitrided layer are found by obtaining simple averages of the values which were measured at any five locations at the cross-section of the steel or bolt.

Note that, the carbon concentration and nitrogen concentration of the steel may be found by measuring the carbon concentration and nitrogen concentration at a position sufficiently deeper than the depth of the low carbon region and nitrided layer, for example, a position at a depth of 2000 μm or more from the surface. Further, it is also possible to obtain an analytical sample from a position at a depth of 2000 μm or more from the surface of the steel or bolt and chemically analyze it to find them.

In the high strength steel of the present invention, as explained above, the delayed fracture is remarkably improved by the synergistic effect of (1) suppression of the absorbed hydrogen content due to the formation of a nitrided layer at the low carbon region which is formed at the steel surface and (2) increase of the critical diffusible hydrogen content due to the formation of the low carbon region at the steel surface.

According to investigations by the inventors, the surface of the steel has a nitrided layer and a low carbon region copresent on it, whereby the absorbed hydrogen content in the steel can be suppressed to 0.10 ppm or less and the critical diffusible hydrogen content of the steel can be raised to 0.20 ppm or more.

Next, the reasons for limitation of the composition of the steel will be explained. Below, the % according to the composition mean mass %.

C: C is an essential element in securing the strength of a steel. If less than 0.10%, the required strength is not obtained, while if over 0.55%, the ductility and toughness fall and the delayed fracture resistance also falls, so the content of C was made 0.10 to 0.55%.

Si: Si is an element which improves strength by solution strengthening. If less than 0.01%, the effect of addition is insufficient, while if over 3%, the effect becomes saturated, so the content of Si was made 0.01 to 3%.

Mn: Mn is an element which not only performs deoxidation and desulfurization, but also gives a martensite structure, so lowers the transformation temperature of the pearlite structure or bainite structure to raise the hardenability. If less than 0.1%, the effect of addition is insufficient, while if over 2%, it segregates at the grain boundary at the time of heating of austenite to embrittle the grain boundary and degrades the delayed fracture resistance, so the content of Mn was made 0.1 to 2%.

The high strength steel or high strength bolt of the present invention may further contain one or more of Cr, V, Mb, Nb, Cu, Ni, and B in a range not impairing the excellent delayed fracture resistance for the purpose of improving the strength.

Cr: Cr is an element which lowers the transformation temperature of the pearlite structure or bainite structure to raise the hardenability and, further, raises the resistance to softening during tempering to contribute to the improvement of the strength. If less than 0.05%, the effect of addition is not sufficiently obtained, while if over 1.5%, deterioration of the toughness is invited, so the content of Cr was made 0.05 to 1.5%.

V: Like Cr, this is an element which lowers the transformation temperature of the pearlite structure or bainite structure to raise the hardenability and, further, raises the resistance to softening during tempering to contribute to the improvement of the strength. If less than 0.05%, the effect of addition is not sufficiently obtained, while if over 0.2%, the effect of addition is saturated, so the content of V was made 0.05 to 0.2%.

Mo: Mo, like Cr and V, is an element which lowers the transformation temperature of the pearlite structure or bainite structure to raise the hardenability and, further, raises the resistance to softening during tempering to contribute to the improvement of the strength. If less than 0.05%, the effect of addition is not sufficiently obtained, while if over 0.4%, the effect of addition is saturated, so the content of V was made 0.05 to 0.4%.

Nb: Nb, like Cr, V, and Mo, is an element which raises the hardenability and the tempering softening resistance to contribute to the improvement of the strength. If less than 0.001%, the effect of addition is not sufficiently obtained. If over 0.05%, the effect of addition becomes saturated, so the content of Nb was made 0.001 to 0.05%.

Cu: Cu is an element which contributes to the improvement of the hardenability, increase of the temper softening resistance, and improvement of strength by the precipitation effect. If less than 0.01%, the effect of addition is not sufficiently obtained, while if over 4%, grain boundary embrittlement occurs and the delayed fracture resistance deteriorates, so the content of Cu was made 0.01 to 4%.

Ni: Ni is an element which raises the hardenability and is effective for improvement of the ductility and toughness which fall along with increased strength. If less than 0.01%, the effect of addition is not sufficiently obtained, while if over 4%, the effect of addition becomes saturated, so the content of Ni was made 0.01 to 4%.

B: B is an element which suppresses grain boundary fracture and is effective for improvement of the delayed fracture resistance. Furthermore, B is an element which segregates at the austenite grain boundary and remarkably raises the hardenability. If less than 0.0001%, the effect of addition cannot be sufficiently obtained, while if over 0.005%, B carbides and Fe borocarbides form at the grain boundaries, grain boundary embrittlement occurs, and delayed fracture resistance falls, so the content of B is made 0.0001 to 0.005%.

The high strength steel and high strength bolt of the present invention may further contain, for the purpose of refining the structure, one or more of Al, Ti, Mg, Ca, and Zr in a range not detracting from the excellent delayed fracture resistance.

Al: Al is an element which forms oxides or nitrides and prevents coarsening of austenite grains to suppress deterioration of the delayed fracture resistance. If less than 0.003%, the effect of addition is insufficient, while if over 0.1%, the effect of addition becomes saturated, so the content of Al is preferably 0.003 to 0.1%.

Ti: Ti also, like Al, is an element which forms oxides or nitrides to prevent coarsening of austenite grains and suppress deterioration of the delayed fracture resistance. If less than 0.003%, the effect of addition is insufficient, while if over 0.05%, the Ti carbonitrides coarsen at the time of rolling or working or at the time of heating in heat treatment and the toughness falls, so the content of Ti is preferably 0.003 to 0.05%.

Mg: Mg is an element which has a deoxidizing and desulfurizing effect and, further, forms Mg oxides, Mg sulfides, Mg—Al, Mg—Ti, and Mg—Al—Ti composite oxides or composite sulfides, etc. to prevent coarsening of austenite grains and suppress deterioration of delayed fracture resistance. If less than 0.0003%, the effect of addition is insufficient, while if over 0.01%, the effect of addition becomes saturated, so the content of Mg is preferably 0.0003 to 0.01%.

Ca: Ca is an element which has a deoxidizing and desulfurizing effect and, further, forms Ca oxides, Ca sulfides, Al, Ti, and Mg composite oxides or composite sulfides, etc. to prevent coarsening of austenite grains and suppress deterioration of delayed fracture resistance. If less than 0.0003%, the effect of addition is insufficient, while if over 0.01%, the effect of addition becomes saturated, so the content of Ca is preferably 0.0003 to 0.01%.

Zr: Zr is an element which forms Zr oxides, Zr sulfides, Al, Ti, Mg, and Zr composite oxides or composite sulfides, etc. to prevent coarsening of austenite grains and suppress deterioration of delayed fracture resistance. If less than 0.0003%, the effect of addition is insufficient, while if over 0.01%, the effect of addition becomes saturated, so the content of Zr is preferably 0.0003 to 0.01%.

Steel Structure

Next, the structure of the high strength steel and high strength bolt of the present invention (below, sometimes called "the steel structure of the present invention") will be explained. The steel structure of the present invention is mainly tempered martensite, so the structure is excellent in ductility and toughness even if the tensile strength is 1300 MPa or more.

The steel structure of the present invention is preferably a structure where the area ratio of the tempered martensite in the region excluding the low carbon region and nitrided layer is 85% or more and the balance is composed of one or more of residual austenite, bainite, pearlite, and ferrite.

The area ratio of the tempered martensite is measured at a deeper position between the depth at which the carbon concentration becomes constant in the carbon concentration curve which is shown in FIG. 2 and the depth where the nitrogen concentration becomes constant in the nitrogen concentration curve which is shown in FIG. 3.

For example, it is sufficient to measure the depth of 2000 μm or more from the surface of the steel or bolt or the area ratio of the tempered martensite at locations of ¼ of the thickness or diameter of the steel.

Note that, the area ratio of martensite can be found by observing the cross-section of the steel using an optical microscope and measuring the area of martensite per unit area. Specifically, the cross-section of the steel is etched by a Nital etching solution, the areas of martensite in five fields in a range of 0.04 $mm^2$ are measured, and the average value is calculated.

Further, in the steel of the present invention, compressive residual stress of the steel surface occurs due to the heating and rapid cooling at the time of nitriding whereby the delayed fracture resistance is improved. If the compressive residual stress occurs by 200 MPa or more, the delayed fracture resistance is improved, so the compressive residual stress of the surface of the steel of the present invention is preferably 200 MPa or more.

The compressive residual stress can be measured by X-ray diffraction. Specifically, the residual stress of the steel surface is measured, then the steel surface is etched 25 μm at a time by electrolytic polishing and the residual stress in the depth direction is measured. It is preferable to measure any three locations and use the average value of the same.

In a steel in which no low carbon region and nitrided layer are formed on the surface, if the tensile strength becomes 1300 MPa or more, the frequency of occurrence of delayed fracture remarkably increases. Therefore, if the tensile strength is 1300 MPa or more, the delayed fracture resistance of the steel of the present invention on which a low carbon region and nitrided layer are formed on the surface is remarkably excellent.

The upper limit of the tensile strength of the present invention is not particularly limited, but over 2200 MPa is technically difficult at the present point of time, so 2200 MPa is provisionally made the upper limit. Note that the tensile strength may be measured based on JIS Z 2241.

Method of Production

Next, a method of production of a steel of the present invention will be explained.

The method of production of a steel of the present invention is composed of a decarburization step of heating a steel of a required composition (wire rod or PC steel bar or steel worked to a predetermined shape) to decarburize it, a hardening step of cooling the decarburized steel to make the steel structure a mainly martensite structure, and a step of nitriding the hardened steel at over 500° C. to 650° C. or less.

Note that, due to the nitriding step, the structure of the steel of the present invention becomes a structure of mainly tempered martensite.

In the decarburization step, the steel of the present invention is decarburized to make the carbon concentration, down from the surface of the steel by a depth of 100 μm or more to 1000 μm or less, 0.05% or more and 0.9 time or less the carbon concentration of the steel. The atmosphere in the heating furnace is, for example, adjusted to a concentration of methane gas to make it weakly decarburizing and form a low carbon region.

The heating temperature in the decarburization is preferably $Ac_3$ to 950° C. By heating to $Ac_3$ or more, it is possible to make the steel structure austenite, promote decarburization from the surface layer, and easily form a low carbon region.

The upper limit of the heating temperature is preferably 950° C. in the point that this suppresses coarsening of the crystal grains and improves the delayed fracture resistance. The holding time at the heating temperature is preferably 30 to 90 minutes. By holding at the heating temperature for 30 minutes or more, it is possible to sufficiently secure the depth of the low carbon region and possible to make the steel structure uniform. If considering the productivity, the holding time at the heating temperature is preferably 90 minutes or less At the hardening step, the heated steel is cooled to obtain a mainly martensite structure. The heated steel may be oil quenched as it is for hardening.

In the steel structure of the present invention, the area ratio of the tempered martensite is preferably 85% or more, so the area ratio of the martensite after hardening is preferably 85% or more. At the hardening step, to secure an area ratio of the martensite of 85% or more, at the time of hardening, it is preferable to make the cooling rate in the range from 700 to 300° C. 5° C./s or more. if the cooling rate is less than 5° C./s, sometimes the area ratio of the martensite becomes less than 85%.

At the nitriding step, a steel with a steel structure of mainly martensite and formed with a low carbon region at the surface layer is nitrided. Due to the nitriding, a nitrided layer is formed with a thickness from the steel surface of 200 μm or more and a nitrogen concentration of 12.0% or less and higher than the nitrogen concentration of the steel by 0.02% or more. At the same time, the steel is tempered to make the steel structure a mainly tempered martensite structure.

The nitriding is performed by, for example, heating the steel in an atmosphere containing ammonia or nitrogen. The nitriding is preferably performed by holding the sample at 500° C. or less, for example 400 to 500° C., for 1 to 12 hours. If the nitriding temperature exceeds 500° C., the steel falls in strength, so the nitriding temperature is made 500° C. or less.

The lower limit of the nitriding temperature is not particularly limited, but if the nitriding temperature is less than 400° C., time is taken for diffusion of nitrogen from the steel surface and the manufacturing cost rises.

If the nitriding time is less than 1 hours, the depth of the nitrided layer is liable not to reach a depth of 200 μm or more from the surface, so the nitriding time is preferably 1 hour or more. The upper limit of the nitriding time is not defined, but if over 12 hours, the manufacturing cost rises, so the nitriding time is preferably 12 hours or less.

Note that, in the nitriding step, the gas nitriding method, nitrocarburizing method, plasma nitriding method, salt bath nitriding method, or other general nitriding method may be used.

Next, the method of production of the high strength bolt of the present invention (below, sometimes referred to as "the present invention bolts") will be explained.

The method of production of the bolt of the present invention is composed of a working step of working the steel of the present invention having the required composition into a bolt, a decarburization step of heating the bolt to decarburize it, a hardening step of cooling the heated bolt to make the steel structure a mainly martensite structure, and a nitriding step of nitriding the hardened bolt at a temperature of over 500° C. to 650° C. or less. In the nitriding step, the steel structure of the bolt becomes a mainly tempered martensite structure.

Note that, in the working step, for example, the steel wire rod is cold forged and rolled to form a bolt.

The method of production of the bolt of the present invention differs from the method of production of the steel of the present invention only in the working step for working the steel into a bolt shape, so the explanation of the other steps will be omitted.

The method of production of the steel of the present invention and the method of production of the bolt of the present invention preferably performs rapid cooling, after nitriding, in a range from 500 to 200° C. by a cooling rate of 10 to 100° C./s. By rapidly cooling after nitriding, it is possible to make the compressive residual stress of the surface of the steel or bolt 200 MPa or more. Due to the presence of this compressive residual stress, the delayed fracture resistance is improved more.

EXAMPLES

Next, examples of the present invention will be explained, but the conditions of the examples are an example of the conditions adopted for confirming the workability and effect of the present invention. The present invention is not limited to this example of the conditions. In the present invention, various conditions can be adopted so long as not departing from the gist of the present invention and achieving the object of the present invention.

Examples

Molten steels of the compositions of ingredients which are shown in Table 1 were cast in accordance with an ordinary method. The cast slabs were hot worked to obtain steels (wire rods). The steels were heated to $Ac_3$ to 950° C. and cooled as is for hardening. Note that, at the time of heating, the atmosphere in the heating furnace was controlled to be weakly decarburizing. The hardening was performed by oil quenching so that the cooling rate in the range of 700 to 300° C. became 5° C./s or more. Further, the depth of the low carbon region was investigated by the carbon potential of the atmosphere of the heating furnace, heating temperature, and holding time.

TABLE 1

| | Composition (mass %) | | | | | | | | | | | | | | |
|---|---|---|---|---|---|---|---|---|---|---|---|---|---|---|---|
| | Steel type | | | | | | | | | | | | | | |
| | C | Si | Mn | Cr | V | Mo | Nb | Cu | Ni | B | Al | Ti | Mg | Ca | Zr |
| A1 | 0.11 | 2.20 | 1.52 | 0.53 | 0.17 | 0.38 | 0.049 | 3.85 | 2.25 | 0.0045 | 0.032 | — | — | 0.0003 | — |
| A2 | 0.16 | 2.50 | 1.98 | 0.4 | — | 0.36 | 0.039 | 2.01 | 1.01 | 0.0031 | 0.089 | 0.005 | 0.0003 | — | 0.0032 |
| A3 | 0.21 | 2.92 | 0.55 | 0.77 | 0.15 | 0.35 | 0.035 | — | 2.95 | 0.0025 | — | 0.012 | 0.0012 | 0.0056 | 0.0003 |
| A4 | 0.26 | 0.98 | 0.98 | 1.48 | 0.18 | 0.39 | — | 1.52 | 0.78 | 0.0019 | 0.098 | 0.009 | 0.0022 | 0.0031 | 0.0044 |
| A5 | 0.31 | 1.98 | 0.78 | 1.28 | 0.09 | 0.29 | 0.025 | 3.98 | 2.01 | 0.0002 | — | 0.031 | 0.0033 | — | — |
| A6 | 0.34 | 1.23 | 0.15 | 1.17 | 0.05 | 0.35 | 0.015 | 0.74 | 3.98 | 0.0004 | 0.021 | 0.049 | 0.0041 | 0.0021 | 0.0045 |
| A7 | 0.34 | 0.95 | 0.34 | 0.07 | 0.18 | 0.35 | 0.006 | 0.49 | 0.28 | 0.0049 | 0.067 | 0.044 | — | — | — |
| A8 | 0.41 | 0.61 | 0.45 | 0.64 | — | 0.05 | 0.002 | — | 0.01 | 0.0044 | 0.011 | 0.039 | 0.0099 | 0.0067 | 0.0036 |
| A9 | 0.41 | 0.35 | 0.72 | 0.29 | 0.2 | — | 0.013 | 0.01 | — | 0.0028 | 0.052 | 0.003 | 0.0088 | 0.0099 | 0.0079 |
| A10 | 0.45 | 0.20 | 0.12 | — | 0.14 | 0.09 | 0.021 | 0.31 | 0.17 | 0.0027 | 0.003 | 0.025 | 0.0052 | 0.0023 | 0.0035 |
| A11 | 0.51 | 0.02 | 0.22 | 0.24 | 0.08 | 0.12 | 0.007 | 0.11 | 0.06 | — | 0.033 | 0.021 | 0.0038 | 0.0011 | 0.0048 |
| A12 | 0.55 | 0.11 | 0.34 | 0.19 | 0.06 | 0.21 | 0.002 | 0.05 | 0.03 | 0.0034 | 0.026 | 0.033 | 0.0055 | 0.0016 | 0.0088 |
| A13 | 0.39 | 0.25 | 0.79 | 1.12 | — | — | — | — | — | — | — | — | — | — | — |
| A14 | 0.39 | 0.25 | 0.76 | 1.06 | — | 0.25 | — | — | — | — | — | — | — | — | — |
| A15 | 0.39 | 0.25 | 0.76 | 1.06 | — | 0.25 | — | — | — | — | 0.025 | — | — | — | — |
| B1 | 0.09 | 0.009 | 0.08 | 0.53 | 0.17 | 0.38 | 0.044 | 3.85 | — | 0.0045 | 0.032 | — | — | 0.0003 | — |
| B2 | 0.60 | 0.12 | 0.22 | 0.24 | 0.08 | 0.12 | 0.007 | 0.11 | 0.06 | — | 0.033 | 0.021 | 0.0038 | 0.0011 | 0.0048 |
| B3 | 0.34 | 0.95 | 2.1 | 0.12 | 0.18 | 0.35 | 0.006 | 0.49 | 0.28 | 0.0045 | 0.067 | 0.044 | 0.0055 | 0.0033 | 0.0068 |
| B4 | 0.21 | 2.54 | 0.55 | 1.6 | 0.15 | 0.35 | — | — | 2.95 | 0.0025 | — | 0.012 | 0.0012 | 0.0056 | 0.0011 |
| B5 | 0.31 | 1.98 | 0.78 | 1.28 | 0.09 | 0.29 | 0.025 | 4.1 | 2.01 | 0.0033 | 0.029 | 0.031 | 0.0033 | — | 0.0012 |
| B6 | 0.41 | 0.51 | 0.45 | 0.64 | — | 0.12 | 0.002 | — | 0.03 | 0.0061 | 0.011 | 0.039 | 0.0076 | 0.0067 | 0.0036 |

(Note)

— in table means not deliberately included

After that, the steel was nitrided by nitrocarburizing to form a nitrided layer. After nitriding, it was rapidly cooled in the range of 500 to 200° C. by the cooling rate which is shown in Table 2 (cooling rate after tempering) to obtain the high strength steels of Manufacturing Nos. 1 to 27.

Note that, the nitriding was performed at a temperature which is shown in Table 2 while making the ammonia volume ratio in the treatment gas atmosphere 30 to 50% and making the treatment time 1 to 12 hours.

The nitrided layer was adjusted in thickness by changing the heating temperature and the holding time. The nitrided layer was adjusted in nitrogen concentration by changing the ammonia volume ratio in the treatment gas atmosphere.

TABLE 2

| | | | | | Nitriding | | Nitrided | | Critical diffusible | | | |
|---|---|---|---|---|---|---|---|---|---|---|---|---|
| Man. no. | Steel type | Tempered martensite ratio (%) | Strength (MPa) | Low carbon region depth (μm) | Temp. (° C.) | Cooling rate (° C./s) | layer thickness (μm) | Compressive residual stress (MPa) | Penetrated hydrogen (ppm) | hydrogen content of delayed fracture (ppm) | Delayed fracture presence | Remarks |
| 1 | A1 | 90 | 1312 | 120 | 400 | 32 | 236 | 306 | 0.05 | 0.35 | No | Inv. |
| 2 | A2 | 87 | 1304 | 980 | 400 | 12 | 323 | 202 | 0.06 | 0.31 | No | ex. |
| 3 | A3 | 86 | 1303 | 560 | 400 | 15 | 336 | 205 | 0.05 | 0.30 | No | |
| 4 | A4 | 94 | 1356 | 450 | 400 | 72 | 232 | 405 | 0.06 | 0.20 | No | |
| 5 | A5 | 89 | 1334 | 268 | 400 | 38 | 245 | 332 | 0.07 | 0.24 | No | |
| 6 | A5 | 90 | 1320 | 976 | 400 | 36 | 246 | 331 | 0.07 | 0.34 | No | |
| 7 | A6 | 92 | 1427 | 968 | 400 | 82 | 201 | 432 | 0.07 | 0.31 | No | |
| 8 | A7 | 98 | 1463 | 643 | 450 | 25 | 212 | 258 | 0.06 | 0.22 | No | |
| 9 | A8 | 99 | 1579 | 109 | 450 | 46 | 256 | 384 | 0.07 | 0.25 | No | |
| 10 | A9 | 94 | 1532 | 153 | 450 | 19 | 321 | 274 | 0.07 | 0.26 | No | |
| 11 | A10 | 95 | 1502 | 104 | 450 | 36 | 278 | 345 | 0.06 | 0.37 | No | |
| 12 | A11 | 98 | 1503 | 889 | 450 | 28 | 261 | 274 | 0.07 | 0.33 | No | |
| 13 | A12 | 99 | 1587 | 346 | 460 | 86 | 244 | 456 | 0.08 | 0.34 | No | |
| 14 | A13 | 85 | 1526 | 256 | 490 | 98 | 223 | 501 | 0.08 | 0.29 | No | |
| 15 | A14 | 89 | 1478 | 348 | 460 | 76 | 243 | 435 | 0.07 | 0.28 | No | |
| 16 | A15 | 91 | 1508 | 412 | 460 | 65 | 234 | 421 | 0.08 | 0.37 | No | |
| 17 | A15 | 94 | 1535 | 256 | 460 | 75 | 233 | 411 | 0.06 | 0.34 | No | |
| 18 | A4 | 94 | 1351 | 210 | 450 | 8 | 205 | 193 | 0.06 | 0.15 | No | |
| 19 | B1 | 92 | 1168 | 103 | 400 | 11 | 336 | 201 | 0.05 | 0.33 | No | Comp. |
| 20 | B2 | 93 | 1535 | 135 | 450 | 98 | 450 | 501 | 0.08 | 0.07 | Yes | ex. |
| 21 | B3 | 91 | 1546 | 146 | 450 | 35 | 289 | 333 | 0.09 | 0.08 | Yes | |
| 22 | B4 | 98 | 1577 | 143 | 450 | 32 | 245 | 345 | 0.08 | 0.08 | Yes | |
| 23 | B5 | 92 | 1563 | 169 | 450 | 82 | 338 | 432 | 0.08 | 0.08 | Yes | |
| 24 | B6 | 92 | 1564 | 213 | 450 | 29 | 269 | 294 | 0.07 | 0.07 | Yes | |

TABLE 2-continued

| Man. no. | Steel type | Tempered martensite ratio (%) | Strength (MPa) | Low carbon region depth (μm) | Nitriding Temp. (° C.) | Nitriding Cooling rate (° C./s) | Nitrided layer thickness (μm) | Compressive residual stress (MPa) | Penetrated hydrogen (ppm) | Critical diffusible hydrogen content of delayed fracture (ppm) | Delayed fracture presence | Remarks |
|---|---|---|---|---|---|---|---|---|---|---|---|---|
| 25 | A3 | 99 | 1345 | 96 | 400 | 12 | 234 | 203 | 0.09 | 0.07 | Yes | |
| 26 | Ar | 94 | 1356 | 211 | 450 | 15 | 195 | 203 | 0.19 | 0.11 | Yes | |
| 27 | A4 | 94 | 1354 | 209 | 440 | 18 | — | 204 | 0.18 | 0.11 | Yes | |

(Note)
Underlines in table are conditions outside scope of present invention
(Note)
"—" in table means nitrided layer with nitrogen concentration 0.02% or more higher than base material is not formed.

The steels which are shown in Table 1 (wire rods) were worked into bolts by the same process as the high strength steels (wire rods) of Manufacturing Nos. 1 to 27 to obtain the high strength bolts of Manufacturing Nos. 28 to 44. The nitriding was performed in the temperature ranges which are shown in Table 3. After the nitriding, the materials were rapidly cooled in the range of 500 to 200° C. by the cooling rates which are shown in Table 3 (cooling rates after tempering).

TABLE 3

| Man. no. | Steel type | Tempered martensite ratio (%) | Strength (MPa) | Low carbon region depth (μm) | Nitriding Temp. (° C.) | Nitriding Cooling rate (° C./s) | Nitrided layer thickness (μm) | Compressive residual stress (MPa) | Penetrated hydrogen (ppm) | Critical diffusible hydrogen content of delayed fracture (ppm) | Delayed fracture presence |
|---|---|---|---|---|---|---|---|---|---|---|---|
| 28 | A1 | 90 | 1311 | 121 | 400 | 33 | 236 | 315 | 0.01 | 0.35 | No |
| 29 | A2 | 87 | 1303 | 981 | 400 | 11 | 323 | 203 | 0.02 | 0.31 | No |
| 30 | A3 | 86 | 1302 | 559 | 400 | 12 | 336 | 204 | 0.01 | 0.30 | No |
| 31 | A4 | 94 | 1355 | 448 | 400 | 75 | 232 | 412 | 0.02 | 0.20 | No |
| 32 | A5 | 89 | 1333 | 467 | 400 | 38 | 245 | 333 | 0.03 | 0.24 | No |
| 33 | A5 | 90 | 1319 | 978 | 400 | 37 | 246 | 328 | 0.03 | 0.34 | No |
| 34 | A6 | 92 | 1426 | 970 | 400 | 76 | 201 | 433 | 0.02 | 0.31 | No |
| 35 | A7 | 98 | 1462 | 645 | 450 | 25 | 212 | 256 | 0.02 | 0.22 | No |
| 36 | A8 | 99 | 1578 | 110 | 450 | 39 | 256 | 378 | 0.03 | 0.25 | No |
| 37 | A9 | 94 | 1531 | 148 | 450 | 19 | 321 | 277 | 0.03 | 0.26 | No |
| 38 | A10 | 95 | 1501 | 103 | 450 | 36 | 278 | 342 | 0.02 | 0.37 | No |
| 39 | A11 | 98 | 1502 | 888 | 450 | 19 | 261 | 278 | 0.02 | 0.33 | No |
| 40 | A12 | 99 | 1586 | 346 | 460 | 99 | 244 | 755 | 0.03 | 0.34 | No |
| 41 | A13 | 85 | 1525 | 257 | 490 | 85 | 223 | 499 | 0.03 | 0.29 | No |
| 42 | A14 | 89 | 1477 | 346 | 460 | 85 | 243 | 441 | 0.02 | 0.28 | No |
| 43 | A15 | 91 | 1507 | 411 | 460 | 82 | 234 | 432 | 0.03 | 0.37 | No |
| 44 | A15 | 94 | 1534 | 258 | 460 | 76 | 233 | 412 | 0.01 | 0.34 | No |

The tempered martensite ratios, tensile strengths, low carbon region depths, nitrided layer thicknesses, compressive residual stresses, absorbed hydrogen content, critical diffusible hydrogen contents, and delayed fracture resistances of the high strength steels of Manufacturing Nos. 1 to 27 (Table 2) and the high strength bolts of Manufacturing Nos. 28 to 44 (Table 3) were measured by the methods which are shown below. The results are shown in Table 2 and Table 3 together.

Tempered Martensite Ratio

The tempered martensite ratio was found by polishing the cross-section of each of the high strength steels of Manufacturing Nos. 1 to 27 and the high strength bolts of Manufacturing Nos. 28 to 44, etching by a Nital etching solution, using an optical microscope to measure the areas of the martensite in five fields in a 0.04 $mm^2$ range, and finding the average value.

Note that in each of the high strength steels of Manufacturing Nos. 1 to 27 and the high strength bolts of Manufacturing Nos. 28 to 44, the structure of the remaining part of the tempered martensite was a balance of one or more of austenite, bainite, pearlite, and ferrite.

Tensile Strength

The tensile strength was measured based on JIS Z 2241.

Low Carbon Region Depth and Nitrided Layer Thickness

A cross-section of each of the high strength steels of Manufacturing Nos. 1 to 27 and the high strength bolts of Manufacturing Nos. 28 to 44 was polished and measured for the carbon concentration and nitrogen concentration in the depth direction from the surface using an EDX at any five locations in the longitudinal direction.

The depth (thickness) of the region where the carbon concentration is 0.9 time or less of the carbon concentration of the steel ((carbon concentration of low carbon region/carbon concentration of steel)≤0.9) was defined as the "low carbon region depth", while the depth (thickness) of the region where the nitrogen concentration is higher than the nitrogen concentration of the steel by 0.02% or more (nitrogen concentration of nitrided layer-nitrogen concentration of steel 0.02) was defined as the "nitrided layer thickness".

Note that, the low carbon region depth and the nitrided layer thickness were the averages of values measured at any five locations in the longitudinal direction.

Compressive Residual Stress

An X-ray residual stress measurement apparatus was used to measure the compressive residual stress of the surface. The residual stress of the surface of each of the high strength steels of Manufacturing Nos. 1 to 27 and the high strength bolts of Manufacturing Nos. 28 to 44 was measured, then the surface was etched by 25 μm at a time by electrolytic polishing and the residual stress in the depth direction was measured. Note that, the compressive residual stress was made the average of the values measured at any three locations.

Critical Diffusible Hydrogen Content and Delayed Fracture Resistance

Figure 4:
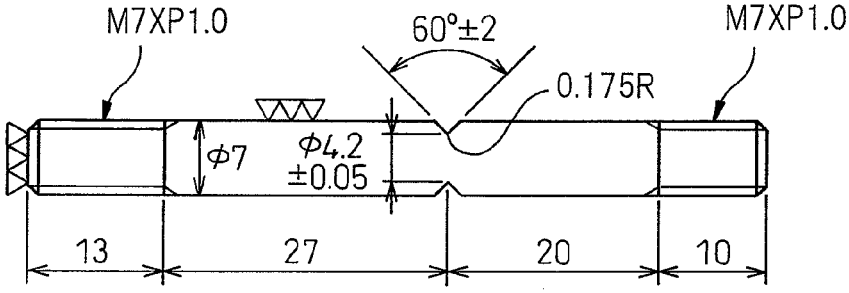
FIG. 4 is a view which shows a test piece which is used for a delayed fracture test of a steel.

From each of the high strength steels of Manufacturing Nos. 1 to 27 and the high strength bolts of Manufacturing Nos. 28 to 44, a delayed fracture test piece of the shape which is shown in FIG. 4 was prepared and subjected to absorption of hydrogen. For absorption of hydrogen, the electrolytic hydrogen charge method was used to change the charge current and change the absorbed hydrogen content as shown by Table 2 and Table 3. The surface of each delayed fracture test piece which was subjected to absorption of hydrogen was plated with Cd to prevent dissipation of the diffusible hydrogen. The test piece was left at room temperature for 3 hours to even the concentration of hydrogen at the inside.

Figure 5:
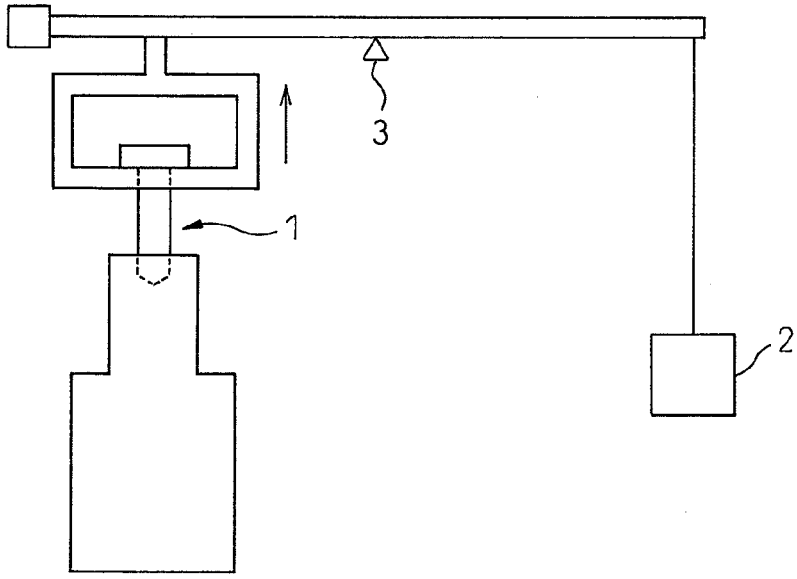
FIG. 5 is a view which shows one mode of a delayed fracture test machine.

After that, a delayed fracture test machine which is shown in FIG. 5 was used to run a constant load delayed fracture test applying a tensile load of 90% of the tensile strength to the test piece 1. Note that, in the test machine which is shown in FIG. 5, when applying a tensile load to the test piece 1, a balance weight 2 was placed at one end of a lever having the fulcrum 3 as the fulcrum and the test piece 1 was placed at the other end to conduct the test.

Further, as shown in FIG. 1(*b*), the maximum value of the amount of diffusible hydrogen of a test piece 1 which did not fracture even after performing the constant load delayed fracture test for 100 hours or more was made the critical diffusible hydrogen content. The amount of diffusible hydrogen of the test piece 1 was measured by raising the delayed fracture test piece in temperature at 100° C./h and measuring the cumulative value of the amounts of hydrogen which were desorbed between room temperature to 400° C. by a gas chromatograph.

When comparing the absorbed hydrogen content and the critical diffusible hydrogen content of delayed fracture and the critical diffusible hydrogen content is greater than the absorbed hydrogen content, delayed fracture does not occur. Conversely, if the critical diffusible hydrogen content is smaller than the absorbed hydrogen content, delayed fracture occurs.

Therefore, the delayed fracture resistance was evaluated as "without delayed fracture" when the absorbed hydrogen content which is shown in Table 2 and Table 3 was less than critical diffusible hydrogen content and as "with delayed fracture" when the absorbed hydrogen content was the critical diffusible hydrogen content or more.

Absorbed Hydrogen Content

Figure 6:
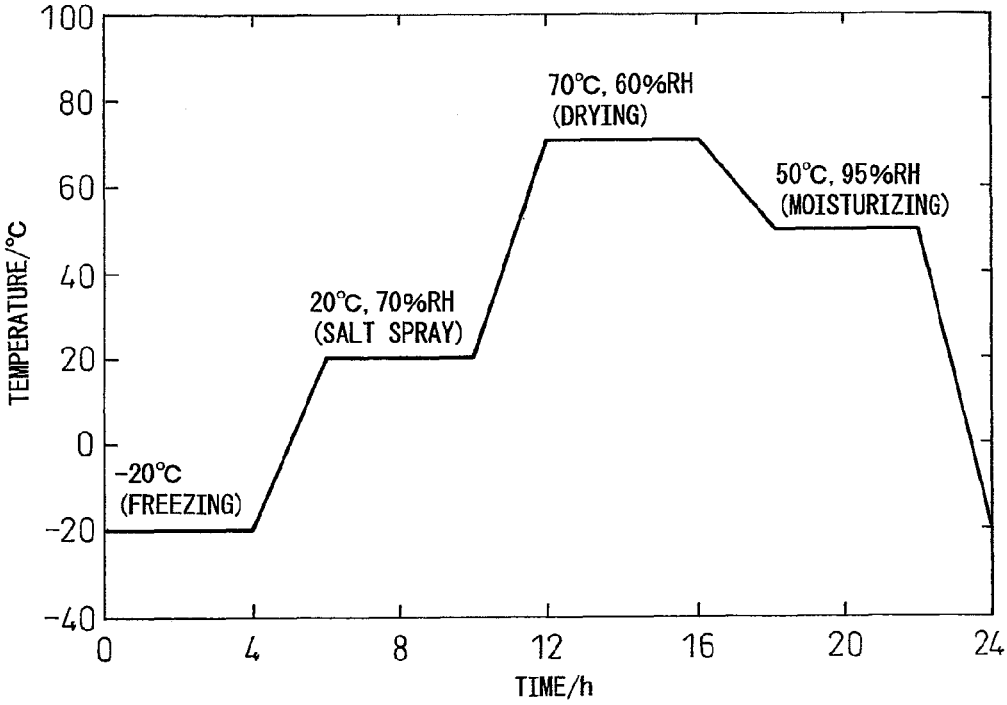
FIG. 6 is a view which shows a relationship between temperature and humidity in an accelerated corrosion test and time.

The absorbed hydrogen content was determined by preparing a test piece of each of the high strength steels of Manufacturing Nos. 1 to 27 and the high strength bolts of Manufacturing Nos. 28 to 44 and running an accelerated corrosion test of the pattern of temperature, humidity, and time which is shown in FIG. 6 for 30 cycles. The corroded layer at the surface of the test piece was removed by sandblasting, then the hydrogen was analyzed by the Thermal desorption analysis. The amount of hydrogen which was desorbed from room temperature to 400° C. was measured to find the absorbed hydrogen content.

As shown in Table 2, the high strength steels of Manufacturing Nos. 1 to 18 of the invention examples had a low carbon region depth of 100 μm or more and a nitrided layer thickness of 200 μm or more. Further, the high strength steels of Manufacturing Nos. 1 to 18 all had a tempered martensite rate of 50% or more and a structure of mainly tempered martensite.

Further, regarding the compressive residual stress, the high strength steels of Manufacturing Nos. 1 to 17 all had a compressive residual stress of 200 MPa or more, but Manufacturing No. 18 has a stress of less than 200 MPa.

The high strength steels of Manufacturing Nos. 1 to 17 of the invention examples all had a tensile strength of 1300 MPa or more, an absorbed hydrogen content of 0.1 ppm or less, a critical diffusible hydrogen content of 0.20 ppm or more, an absorbed hydrogen content of less than the critical diffusible hydrogen content, and a resistance of "without delayed fracture".

The high strength steel of Manufacturing No. 18 is an invention example, but the cooling rate after tempering was slow, so the compressive residual stress was lower than the high strength steels of Manufacturing Nos. 1 to 17 and the critical diffusible hydrogen fell content, but the tensile strength was 1300 MPa or more, the absorbed hydrogen content was 0.1 ppm or less, the critical diffusible hydrogen content, and the resistance was "without delayed fracture".

As opposed to this, as shown in Table 2, the high strength steel of Manufacturing No. 19 of the comparative example was an example where the amount of C, the amount of Si, and the amount of Mn were small and the strength was low. Manufacturing No. 20 is an example where the amount of C was large, Manufacturing No. 21 is an example where the amount of Mn was large, Manufacturing No. 22 is an example where the amount of Cr was large, Manufacturing No. 23 is an example where the amount of Cu was large, and Manufacturing No. 24 is an example where the amount of B was large, so the critical diffusible hydrogen content was low and the resistance was "with delayed fracture".

Further, Manufacturing No. 25 is an example where the heating time of the hardening was short, the low carbon region depth was less than 100 μm, the critical diffusible hydrogen content was low, and the resistance was "with delayed fracture". Manufacturing No. 26 is an example where the nitriding time was short, the nitrided layer thickness was less than 200 μm, the absorbed hydrogen content was large, and the resistance was "with delayed fracture".

Manufacturing No. 27 is an example in which the concentration of ammonia in the gas of the nitriding was lowered, so at a location down to the depth of 200 μm from the surface, the difference of the nitrogen concentration from the steel became 0.01 mass %, the absorbed hydrogen content was larger, and the resistance was "with delayed fracture".

As shown in Table 3, the high strength bolts of Manufacturing Nos. 28 to 44 of the invention examples had a low carbon region depth of 100 μm or more and a nitrided layer thickness of 200 μm or more. All had a tensile strength of 1300 MPa or more, an absorbed hydrogen content of 0.1 ppm or less, a critical diffusible hydrogen content of 0.20 ppm or more, an absorbed hydrogen content of less than the critical diffusible hydrogen content, and a resistance "without delayed fracture".

The high strength bolts of Manufacturing Nos. 28 to 44 all had a tempered martensite ratio of 50% or more, a structure of mainly tempered martensite, and a compressive residual stress of 200 MPa or more.

From Table 2 and Table 3, it will be understood that the high strength bolts of Manufacturing Nos. 28 to 44, which differ from the high strength steels of Manufacturing Nos. 1 to 17 only in the point of working the steel (wire rod) to bolts (high strength bolts of Manufacturing Nos. 28 to 44 correspond to high strength steels of Manufacturing Nos. 1 to 17), were further suppressed in the absorbed hydrogen content compared with the high strength steels.

INDUSTRIAL APPLICABILITY

As explained above, according to the present invention, it is possible to provide a high strength steel (wire rod or PC steel bar) and high strength bolt which exhibit excellent delayed fracture resistance even in a severe corrosive environment and a method of production enabling inexpensive production of these. Accordingly, the present invention is extremely high in applicability in industries manufacturing and using steels.

REFERENCE SIGNS LIST

1 test piece
2 balance weight
3 fulcrum

The invention claimed is:

1. A high strength steel containing, by mass %,
C: 0.10 to 0.55%,
Si: 0.01 to 3%, and
Mn: 0.1 to 2%,
further containing one or more of
Cr: 0.05 to 1.5%,
V: 0.05 to 0.2%,
Mo: 0.05 to 0.4%,
Nb: 0.001 to 0.05%,
Cu: 0.01 to 4%,
Ni: 0.01 to 4%, and
B: 0.0001 to 0.005%, and
having a balance of Fe and unavoidable impurities, the structure being a tempered martensite structure having an area ratio of 85% or more,
the surface of the steel being formed with
(a) a nitrided layer having a thickness from the surface of the steel of 200 μm or more and a nitrogen concentration of 12.0 mass % or less and higher than the nitrogen concentration of the steel by 0.02 mass % or more and
(b) a low carbon region having a depth from the surface of the steel of 100 μm or more to 1000 μm or less and having a carbon concentration of 0.05 mass % or more and 0.9 time or less the carbon concentration of the steel,
wherein a hardness of the surface of the steel is less than or equal to a hardness of the remaining portion of the steel.

2. A high strength steel as set forth in claim 1 characterized in that due to the presence of the nitrided layer and low carbon region, an absorbed hydrogen content in the steel is 0.10 ppm or less and a critical diffusible hydrogen content of the steel is 0.20 ppm or more.

3. A high strength steel as set forth in claim 1 characterized in that said steel further contains, by mass %, one or more of
Al: 0.003 to 0.1%,
Ti: 0.003 to 0.05%,
Mg: 0.0003 to 0.01%,
Ca: 0.0003 to 0.01%, and
Zr: 0.0003 to 0.01%.

4. A high strength steel as set forth in claim 1 characterized in that the nitrided layer has a thickness of 1000 μm or less.

5. A high strength steel as set forth in claim 2 characterized in that said steel further contains, by mass %, one or more of
Al: 0.003 to 0.1%,
Ti: 0.003 to 0.05%,
Mg: 0.0003 to 0.01%,
Ca: 0.0003 to 0.01%, and
Zr: 0.0003 to 0.01%.

6. A high strength steel as set forth in claim 2 characterized in that the nitrided layer has a thickness of 1000 μm or less.

7. A high strength steel as set forth in claim 1 characterized in that the steel has a compressive residual stress at the surface of 200 MPa or more.

8. A high strength steel as set forth in claim 1 characterized in that the steel has a tensile strength of 1300 MPa or more.

9. A method of production of a high strength steel as set forth in claim 1,
the method of production of a high strength steel which is excellent in delayed fracture resistance characterized by
(1) heating a steel having a composition as set forth in claim 1 to form a low carbon region having a depth from the surface of the steel of 100 μm or more to 1000 μm or less and having a carbon concentration of 0.05 mass % or more and 0.9 time or less the carbon concentration of the steel, then cooling as it is to make the steel structure a martensite structure having an area ratio of 85% or more, then
(2) nitriding the steel at 500° C. or less to form on the surface of the steel a nitrided layer having a nitrogen concentration of 12.0 mass % or less and higher than the nitrogen concentration of the steel by 0.02 mass % and having a thickness from the surface of the steel of 200 μm or more and to make the steel structure a tempered martensite structure having an area ratio of 85% or more.

10. A method of production of a high strength steel as set forth in claim 9 characterized in that the nitrided layer has a thickness of 1000 μm or less.

11. A high strength bolt obtained by working a steel containing,
by mass %,
C: 0.10 to 0.55%,
Si: 0.01 to 3%, and
Mn: 0.1 to 2%,
further containing one or more of
Cr: 0.05 to 1.5%,
V: 0.05 to 0.2%,
Mo: 0.05 to 0.4%,
Nb: 0.001 to 0.05%,
Cu: 0.01 to 4%,
Ni: 0.01 to 4%, and
B: 0.0001 to 0.005%, and
having a balance of Fe and unavoidable impurities, the structure being a tempered martensite structure having an area ratio of 85% or more,
the surface of the bolt being formed with
(a) a nitrided layer having a thickness from the surface of the bolt of 200 μm or more and a nitrogen concentration of 12.0 mass % or less and higher than the nitrogen concentration of the steel by 0.02 mass % or more and
(b) a low carbon region having a depth from the surface of the bolt of 100 μm or more to 1000 μm or less and having a carbon concentration of 0.05 mass % or more and 0.9 time or less the carbon concentration of the steel,
wherein a hardness of the surface of the steel is less than or equal to a hardness of the remaining portion of the steel.

12. A high strength bolt as set forth in claim 11 characterized in that due to the presence of the nitrided layer and low carbon region, an absorbed hydrogen content in the bolt is 0.10 ppm or less and a critical diffusible hydrogen content of the bolt is 0.20 ppm or more.

13. A high strength bolt as set forth in claim 11 characterized in that said steel further contains, by mass %, one or more of
Al: 0.003 to 0.1%,
Ti: 0.003 to 0.05%,
Mg: 0.0003 to 0.01%,
Ca: 0.0003 to 0.01%, and
Zr: 0.0003 to 0.01%.

14. A high strength bolt as set forth in claim 11, characterized in that the nitrided layer has a thickness of 1000 μm or less.

15. A high strength bolt as set forth in claim 11, characterized in that the bolt has a compressive residual stress at the surface of 200 MPa or more.

16. A high strength bolt as set forth in claim 11, characterized in that the bolt has a tensile strength of 1300 MPa or more.

17. A method of production of a high strength bolt as set forth in claim 11, the method of production of a bolt which is excellent in delayed fracture resistance characterized by (1) heating a bolt obtained by working a steel having a composition as set forth in claim 8 to form a low carbon region having a depth from the surface of the bolt of 100 μm or more to 1000 μm or less and having a carbon concentration of 0.05 mass % or more and 0.9 time or less the carbon concentration of the steel, then cooling as it is to make the steel structure a martensite structure having an area ratio of 85% or more, then (2) nitriding the bolt at 500° C. or less to form on the surface of the bolt a nitrided layer having a nitrogen concentration of 12.0 mass % or less and higher than the nitrogen concentration of the steel by 0.02 mass % and having a thickness from the surface of the bolt of 200 μm or more and to make the steel structure a tempered martensite structure having an area ratio of 85% or more.

18. A method of production of a high strength bolt as set forth in claim 17, characterized in that the nitrided layer has a thickness of 1000 μm or less.

* * * * *